US006939202B2

(12) United States Patent
Heidrich et al.

(10) Patent No.: US 6,939,202 B2
(45) Date of Patent: Sep. 6, 2005

(54) SUBSTRATE RETAINER WEAR DETECTION METHOD AND APPARATUS

(75) Inventors: Kevin E. Heidrich, Beaverton, OR (US); Liam S. Roberts, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 64 days.

(21) Appl. No.: 10/640,735

(22) Filed: Aug. 13, 2003

(65) Prior Publication Data

US 2005/0037690 A1 Feb. 17, 2005

(51) Int. Cl.[7] ..... B24B 1/00

(52) U.S. Cl. ..... 451/9; 451/8; 451/21; 451/41; 451/285; 451/398

(58) Field of Search ..... 451/41, 285, 286, 451/287, 21, 9, 10, 11, 398

(56) References Cited

U.S. PATENT DOCUMENTS 6,390,908 B1 * 5/2002 Chen et al. ..... 451/398
6,702,646 B1 * 3/2004 Gitis et al. ..... 451/5

* cited by examiner

*Primary Examiner*—Eileen P Morgan
(74) *Attorney, Agent, or Firm*—Schwabe, Williamson & Wyatt, P.C.

(57) ABSTRACT

An apparatus and method are provided for detecting wear in substrate retainers used for chemical mechanical planarization processes. A substrate retainer is provided that is adapted to enable a sensor to detect when the wear edge of the retainer has worn to a critical wear threshold so that the retainer may be replaced prior to failure.

34 Claims, 4 Drawing Sheets

SUBSTRATE RETAINER WEAR DETECTION METHOD AND APPARATUS

FIELD OF THE INVENTION

Disclosed embodiments of the invention relate to integrated circuit (IC) manufacturing. More specifically, disclosed embodiments of the invention relate to substrate retainers used in chemical mechanical planarization machines and processes, including a sensor method and apparatus for in situ detection of substrate retainer wear.

BACKGROUND

Chemical Mechanical Planarization (CMP), or Chemical Mechanical Polishing is a process commonly used to remove topography from wafers during the manufacturing of integrated circuits (ICs). Generally, CMP is a process of smoothing and planing surfaces with the combination of chemical and mechanical forces. CMP is most widely utilized in back-end IC manufacturing.

FIG. 1 shows a typical CMP apparatus and some of the primary components. A CMP head 10 is coupled to a CMP machine by spindle 13 and transmits movement (linear, rotary, and/or orbital) to a wafer 12. Head 10 also carries the appropriate connections to support the internal workings required by head 10 in the CMP process (e.g. pneumatic lines). Head 10 includes carrier 14, which supports a wafer backer 15 and a retaining ring 18. Backer 15 is designed to load/unload the wafer as well as provide physical support and process control options during processing (e.g. apply back pressure and allow wafer to float within a given tolerance during processing). Retaining ring 18 is removably coupled to carrier 14 and is designed to hold the wafer within the head 10 during CMP processing. Opposite carrier 10 is polishing pad 22. Polishing Pad 22 is coupled to a rotatable platen or table 26, which causes the polishing pad 22 to rotate as shown by rotation line 24.

During the CMP process, wafer 12, being removably coupled to a head 14, is inverted such that the integrated circuit-embodied surface opposably faces a polishing pad 22. Polishing pad 22 is saturated with a slurry 30 that may contain abrasive particles and a mild chemical etchant that softens or catalyzes the exposed surface of wafer 12 being planarized. Wafer 12 is polished by placing it into contact with the polishing pad 22 and slurry 30 while the polishing pad 22 is rotated. The surface roughness of the integrated circuit-embedded exposed surface of wafer 12 is removed by the combined action of chemical softening of the exposed surface of wafer 12 and physical abrasion brought about by relative movement and pressure between the polishing pad 22, the slurry 30 and wafer 12.

Because Retaining ring 18 keeps wafer 12 in position during the polishing process, the ring wear edge 28 also contacts the polishing pad 22 and slurry 30. Accordingly, retaining ring 18 may succumb to wear, and thus has a finite life. As retainer ring 18 wears, one or more portions of wear edge 28 may tend to recede or move "inward". Because backer 15 is designed to float, as retaining ring 18 wears, the wafer 12 also floats such that the retaining ring will still be effective despite wear. When retaining ring 18 wears to a point such that it begins to float (i.e. the wafer and backer are past their designed mechanical tolerance), the wafer will no longer be held in place and may be undesirably ejected from carrier 10. At this point, one or more portions of wear edge 28 may be considered as having receded or moved "inward" along respective inward directions in excess of one or more failure thresholds. Another problem with too much wear, particularly on retaining rings that are slotted on the ring edge 28 to allow slurry and waste to enter and exit the retaining ring perimeter, is that the flow characteristics of the slurry will be changed which can negatively impact the planarization process.

The current industry practice for monitoring retaining ring wear and failure include manual inspection or estimation. Ring edge wear (i.e. inward recession of the wear edge) is often monitored by periodic inspection and measurement using instruments such as a caliper and the like. This technique, however, is time consuming, inaccurate and increases the potential for system contamination. Accordingly, users typically opt to routinely change out the retainer rings after processing a certain number of wafers. Based on factors such as the processing parameters, retaining ring material, slurry composition, pressure and the like, the typical change out is made long before the retaining ring is worn out. Though erring on the side of caution prevents damaging wafers and helps to ensure process consistency, replacing retaining rings with a substantial amount of life remaining wastes resources and money.

BRIEF DESCRIPTION OF THE DRAWINGS

The invention is illustrated by way of example and not by way of limitation in the figures of the accompanying drawings, in which the like references indicate similar elements and in which.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Figure 1:
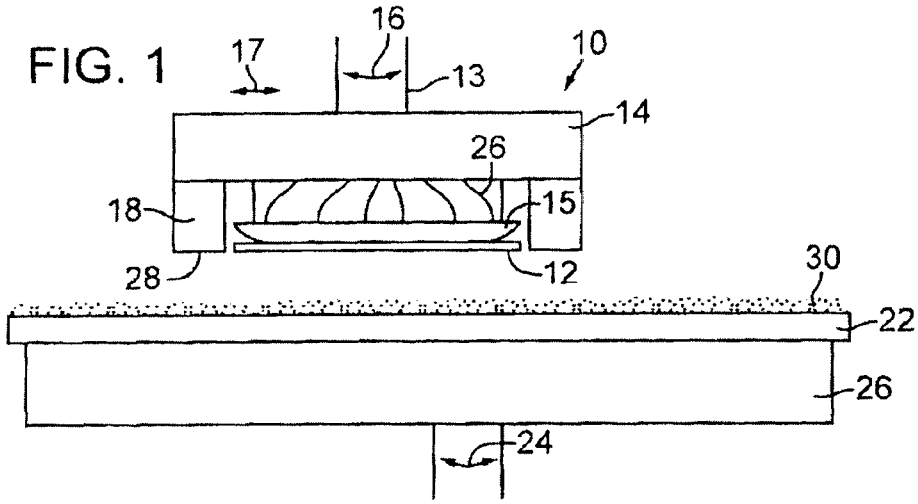
FIG. 1 illustrates a cross sectional view of a portion of an example CMP machine.
Figure 2:
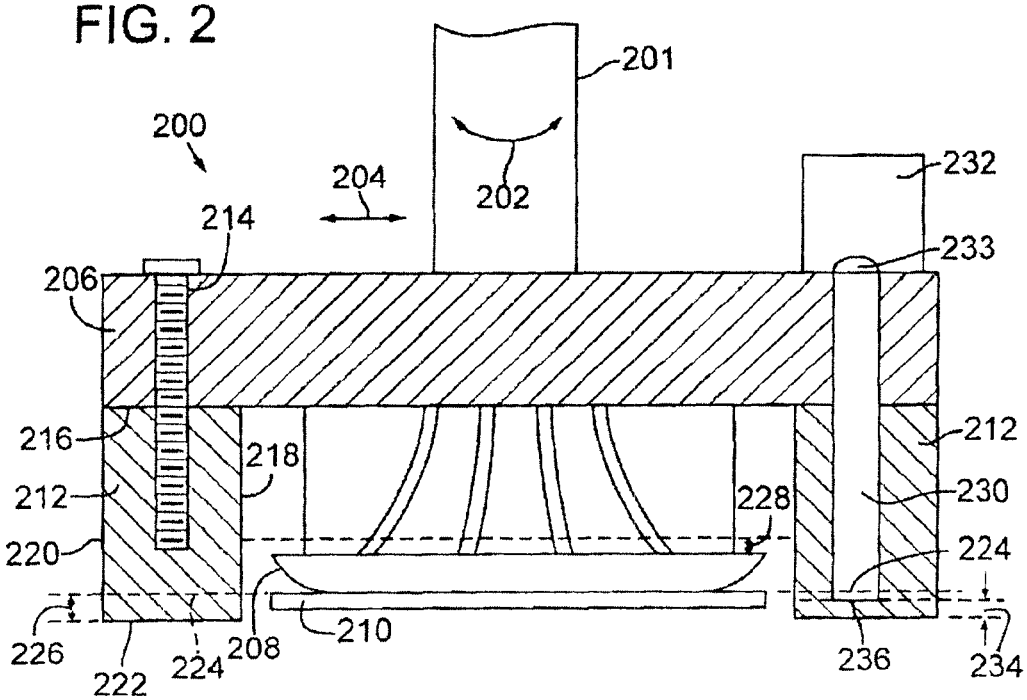
FIG. 2 illustrates a cross sectional view of a CMP head in accordance with an embodiment of the present invention.

FIG. 2 is a cross sectional view of a CMP head in accordance with an embodiment of the present invention. Head 200 is similar to that described with respect to FIG. 1. Head 200 is coupled to a CMP machine through spindle 201 and is adapted for rotational and transverse movement, as indicated by lines 202 and 204 respectively. Head 200 includes carrier 206. Carrier 206 may be interconnected to substrate backer 208, which functions to help control substrate 210 during the polishing or planarization process. Substrate retainer 212 may be removably coupled to carrier 206, often times by screw 214, though any other securing mechanism would suffice.

Retainer 212 can be of any desired shape, but are typically circular in order to accommodate processing common substantially circular IC wafer substrates. Retainer 212 has an inner wall 218, an outer wall 220, a top edge 216 and bottom or wear edge 222. Because the wear edge 222 recedes during the CMP process—due to contact with the slurry and polishing pad (not shown), the retaining ring 212 has a finite life. Depending on the process, wear edge 222 can only recede to a certain failure threshold 224, at which point retainer 212 may no longer adequately retain substrate 210 within its periphery during the CMP process (i.e. retainer failure).

The failure threshold 224 may be the point at which backer 208 no longer can float, as it has reached its float tolerance 228, and thus retainer 212 may begin to float. Floating of retainer 212 may allow substrate 210 to undesirably exit the process area. It is thus preferable to change retainer 212 at or before the reaching the failure threshold 224. For ease of understanding, failure threshold 224 (i.e. the limiting threshold distance wear edge 222 may recede before retainer failure) is illustrated as substantially constant for the entire wear edge 222. However, in practice, different portions of wear edge 222 may have different failure thresholds, depending on process conditions and desired product output.

A sensor 232 may be coupled to carrier 206 that can sense when wear edge 222 recedes to a certain critical wear threshold 236 prior reaching the failure threshold 224. Critical wear threshold represents an acceptable level of wear edge 22 recession, which is typically less than the recession required to reach the failure threshold 224. The difference between the two quantities represents an acceptable safety factor. For the present application, the terms "failure point" and "failure limiting threshold distance" (over which a wear edge may recede) are considered synonymous, unless the context expressly indicated otherwise. Similarly, the terms "critical point" and "critical wear threshold" are considered synonymous, unless the context expressly indicated otherwise.

The sensor 232 can trigger a flag (e.g. digital or analog signal) when the wear edge 222 reaches the critical wear threshold, so that the process can be stopped and the retainer changed prior to failure. This can reduce maintenance intervals, hardware failures, and/or substrate loss. The sensing by the sensor 232 can take place during the CMP process or during a substrate change out, either in real time or upon user inquiry.

Sensor path 230 may be disposed in retainer 212, and complementarily disposed in carrier 206 as necessary, such that wear edge 222 is sense-ably coupled with sensor 232, (i.e. recession of wear edge 222 due to wear may be sensed by sensor 232). In the embodiment illustrated in FIG. 2, sensor 232 includes a photocell or photodiode 233 that can detect changes in light, as wear edge 222 recedes due to wearing. The photocell 233 can be interconnected to a sensing circuit within sensor 232 that may trigger the flag (e.g. in the form of a signal) when a certain change in light is detected, and if desired, send the signal to the CMP machine control.

Figure 3:
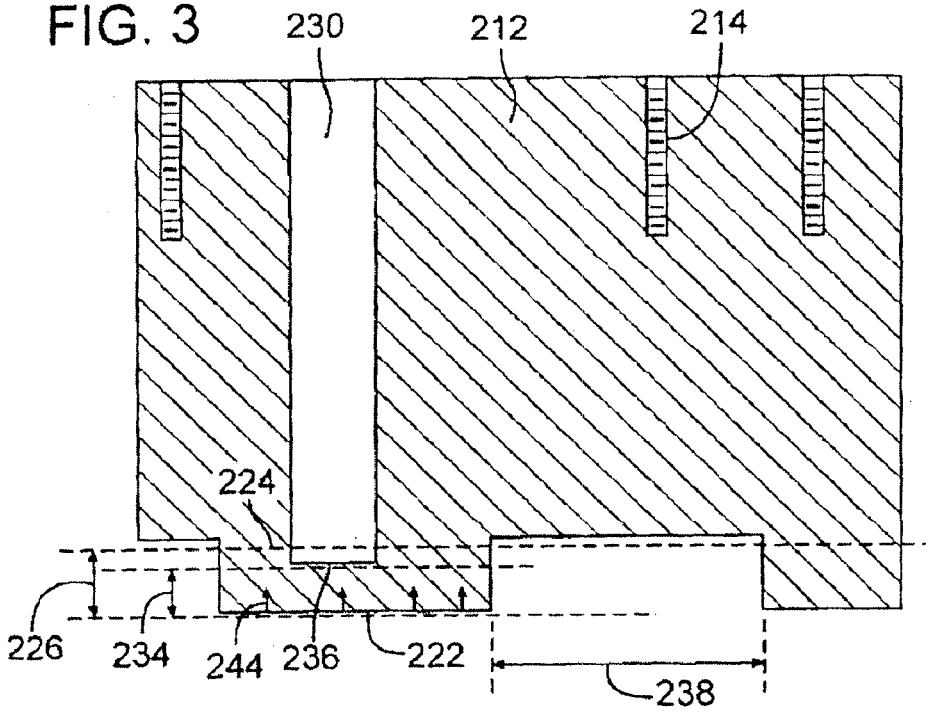
FIG. 3 illustrates an enlarged cross sectional view of the substrate retainer depicted in FIG. 2 in accordance with an embodiment of the present invention.

FIG. 3 illustrates an enlarged cross sectional view of the retainer 212 shown in FIG. 2 in accordance with one embodiment of the present invention. Retainer 212 has slots 238 that allow slurry and waste to pass from the inner perimeter of retainer 212 defined by inner wall 218 to a point beyond the outer wall 220 portion. Sensor path 230 may extend to critical wear threshold 236. As described earlier, the distance between wear edge 222 and the critical wear threshold 236 thereby defines an acceptable wear thickness 234. When wear edge 222 recedes inwardly, as shown by wear arrows 244, to the critical wear threshold 236 (i.e. wear thickness 234 becomes substantially equal to zero), there will be a change in the amount of light passing through sensor path 230.

Referring back to FIG. 2, being sense-ably coupled to wear edge 222, sensor 232 may detect the change in light. When a certain threshold change (e.g. the critical wear threshold) is reached, sensor 232 may trigger a flag indicating that the retainer 212 is ready to be changed. It is preferable that the critical wear threshold 236 be set far enough apart from the failure point 224 such that the wear thickness 234 can be maximized, while leaving enough margin of error for allowing the retainer 212 to be changed before reaching the failure threshold 224.

Typically, the change in light level will be detected at the time a new substrate is loaded into head 200, as the retainer 212 will not be in contact with the slurry and/or polishing pad. If the ambient light is insufficient to enable the sensor to detect change, an additional light source may be added to the CMP machine load and unload area or between polish modules to enhance the sensor's effectiveness. Also, the sensor may send a signal depending on the amount of change in light that has occurred at each sensing interval. In such a case, the user can monitor how close the retainer 212 is to reaching the critical wear threshold 236.

Figure 4:
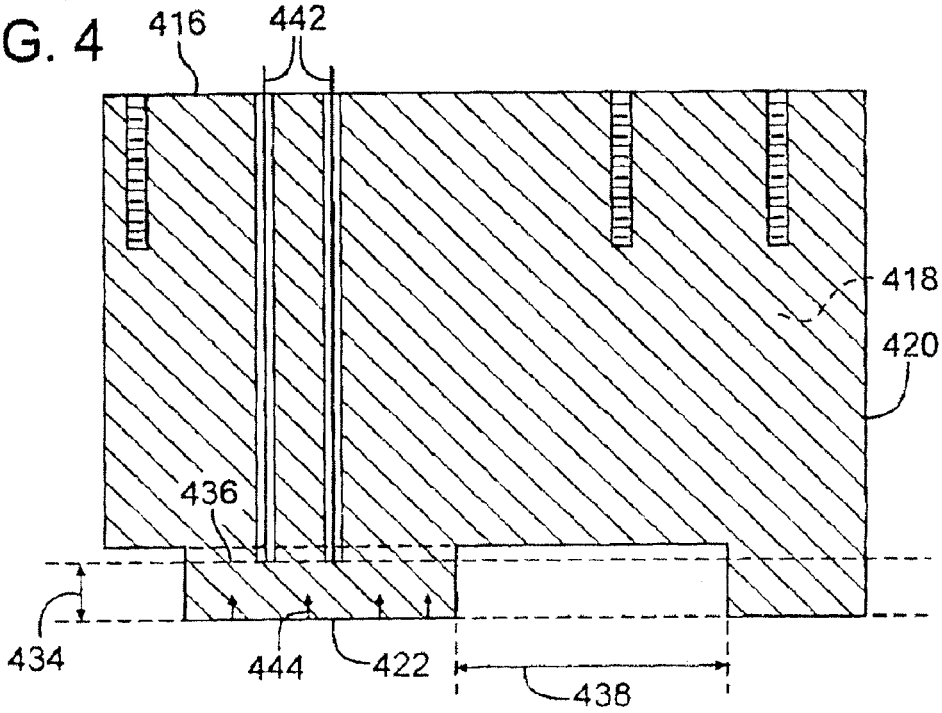
FIG. 4 illustrates a cross sectional view of a substrate retainer in accordance with an embodiment of the present invention.

FIG. 4 illustrates an enlarged cross sectional view of a slotted retainer in accordance with an embodiment of the present invention. Retainer 412 has slots 438 that allow slurry and waste to pass from the inner perimeter of retainer 412 defined by inner wall 418 to a point beyond the outer wall 420 portion of retainer 412. Sensor paths 430 extend from the top edge 416 to a critical wear threshold 436. In the illustrated embodiment, conductive traces 442 disposed within sensor paths 430, extend from the critical wear threshold 436 to the top edge 416, to sense-ably couple wear edge 422 to a sensor (not shown). Conductive traces 442 have exposed ends 445, 446 positioned substantially at the critical wear threshold 236. Conductive traces 442 are not electrically interconnected when wear thickness 434 is more than nominally greater than zero.

As shown, conductive traces 442 are electrically insulated from each other by the material of retainer 412 that separates the sensor paths 430. It can be appreciated that conductive traces 442 could be disposed within the same sensor path 430 and electrically insulated from each other by a dielectric material disposed about the conductive traces 442 or by filling the sensor path 430 with a dielectric material once the conductive traces 442 are positioned within the sensor path 430. It can also be appreciated that sensor path 430 and conductive traces 442 need not extend to the top edge 416, but may extend to a position at the outer wall 420 or inner wall 418, such that conductive traces 442 may be adapted for electrical communication with a sensor (not shown).

Conductive traces 442 may be adapted for electrical communication with a sensor (not shown), which can be, for example, an open circuit coupled to a current detection device. As wear edge 422 recedes, as shown by arrows 444, to the critical wear threshold 436, the conductive trace ends 445, 446 are exposed to the slurry (not shown). The presence of the electrolytes in the slurry may complete the circuit allowing current to flow from end 445 and end 446. The current detection device (sensor) can then detect the current flow and trigger a flag indicating that the retainer 412 needs to be replaced.

In another embodiment, though not shown, the conductive trace may also be a closed loop/circuit that is electrically interconnected to a sensor (not shown) that may be, for example, configured to detect a change in resistance. A middle portion of the conductive trace may be disposed at or near the critical wear threshold 436 in sensor path 430 and have a known resistance. Thus, when the wear edge 422 recedes to the critical wear threshold 436, the conductive trace will exposed, resulting in resistance change that will cause the sensor to trigger a flag that the retainer needs to be replaced.

Figure 5:
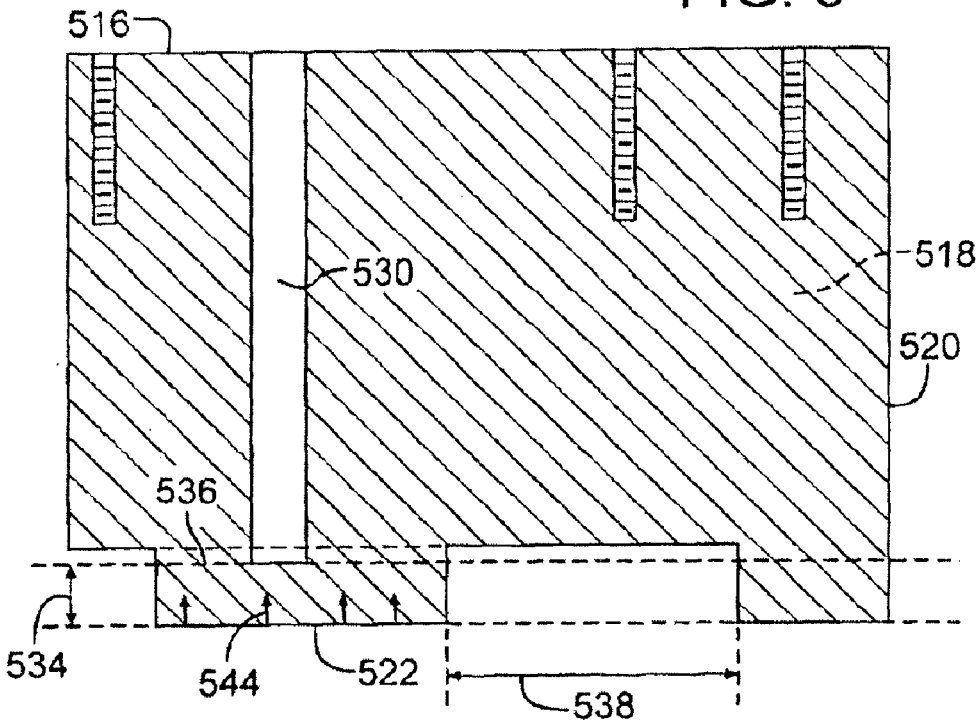
FIG. 5 illustrates a cross sectional view of a substrate retainer in accordance with an embodiment of the present invention.

FIG. 5 illustrates a cross sectional view of a slotted retainer in accordance with another embodiment of the present invention. As with the previous described embodiments, retainer 512 has slots 538 that allow slurry and waste to pass from the inner perimeter of retainer 512 defined by inner wall 518 to a point beyond the outer wall 520. As illustrated, sensor path 530 extends from the top edge 516 to a critical wear threshold 536. Again, sensor path 530 need not extend to the top edge 516, but may extend to a position at the outer wall 520 or inner wall 518, such that it may be adapted for communication with a sensor.

Sensor path 530 is adapted to be pressurized, such that gas (e.g. air) under pressure may sense-ably couple wear edge 522 to a sensor (not shown) that is adapted to detect a change in pressure. Accordingly, a positive pressure or a negative pressure (i.e. a vacuum) may be supplied to the sensor path 530. When wear edge 522 has receded to the critical wear threshold 536, the sensor path is exposed, which in turn may cause the pressure to change. If under a positive pressure the sensor path will depressurize and may return to the ambient pressure of the CMP machine. Likewise, if under a negative pressure, the sensor path will repressurize to the ambient pressure of the CMP machine. It is the change in pressure that the pressure sensor may detect, and upon reaching the threshold change, the sensor may trigger a flag.

Figure 6:
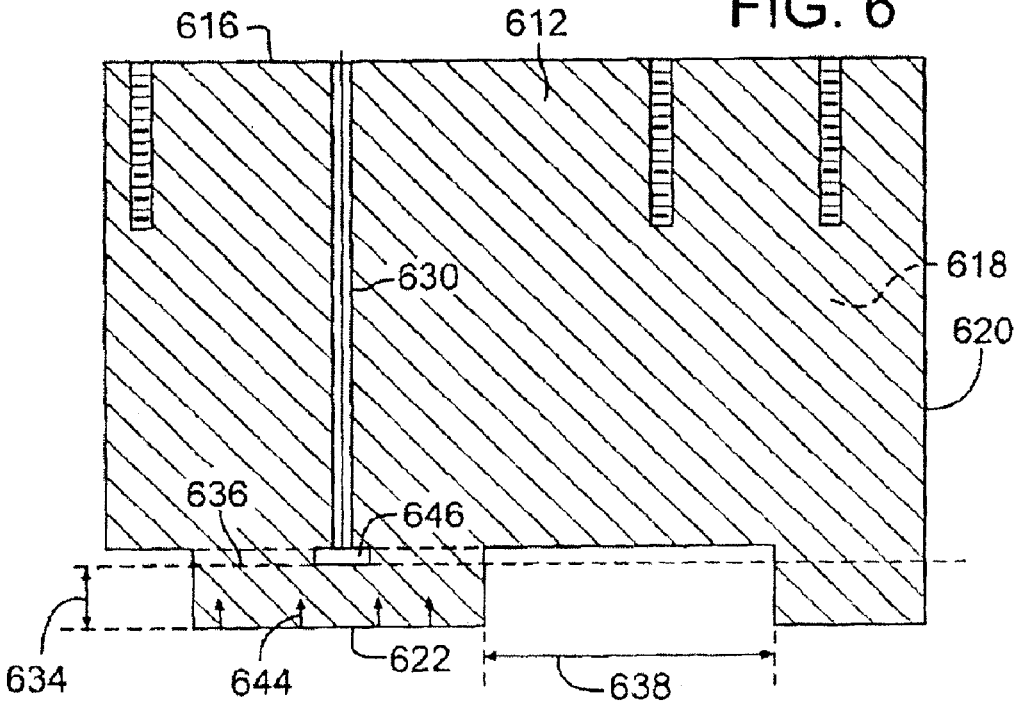
FIG. 6 illustrates a cross sectional view of a substrate retainer in accordance with an embodiment of the present invention.

FIG. 6 illustrates a cross sectional view of a slotted retainer in accordance with another embodiment of the present invention. As with the previous described embodiments, retainer 612 has slots 638 that allow slurry and waste to pass from the inner perimeter of retainer 612 defined by inner wall 618 to a point beyond the outer wall 620 portion of retainer 612. A capacitor 646 may be disposed within sensor path 630 at the critical wear threshold 636, such that the capacitor capacitance may sense-ably couple wear edge 622 to a sensor (not shown) that includes a circuit adapted to detect capacitance change and trigger a flag when a certain capacitance is detected.

Capacitor 646 may have a known capacitance when the retainer is in a new or unworn condition, and a known capacitance when the retainer is in a worn condition and ready for replacement. As the wear edge 622 recedes toward the critical wear threshold 636, as shown by recession arrows 644, and thus the edge of capacitor 646, the capacitance sensor detects the changing capacitance as a result of the change in dielectric properties of the retainer 612. After a threshold level of change is detected, the capacitance sensor may trigger a flag.

The change detected by the sensor may be gradual, such that the machine operator may have an indication of the wear rate and have an indication as to when the critical wear thickness 634 is approaching or at zero, thus requiring a retainer change. For example, as the wear edge wears away, the amount of light that passes through the remaining wear thickness into the sensor path will gradually increase. Thus the photocell can sense the gradual change output a correspondingly changing signal. Another example would be using a plurality of closed loop conductive traces that could sense wear over time.

Figure 7:
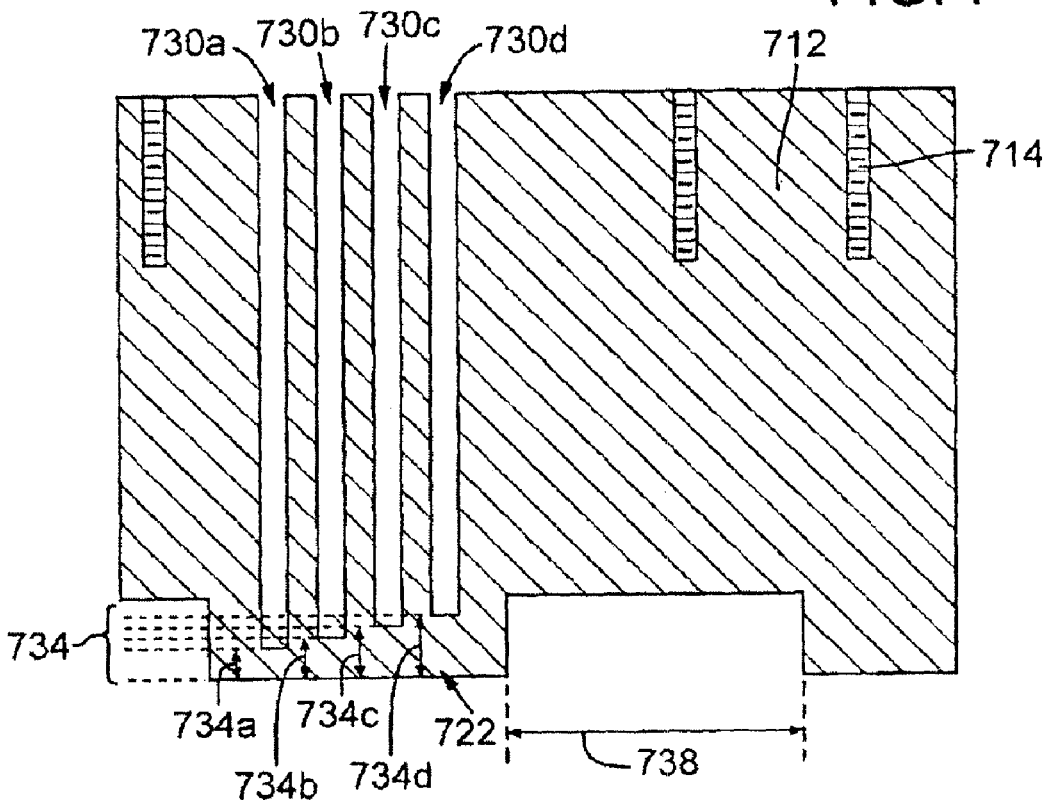
FIG. 7 illustrates a cross sectional view of a substrate retainer in accordance with an embodiment of the present invention.

FIG. 7 illustrates a cross sectional view of a substrate retainer in accordance with an embodiment of the present invention. An array of sensor paths 730 *a–d* is shown, which may enable the sensor to gradually detect the decline in wear edge thickness as the retainer is used. Each sensor path has a different critical wear threshold 736 *a–d*, which results in a corresponding number of differing critical wear thicknesses 734 *a–d*. Using such an array, the wear thickness 734 may be periodically monitored to detect recession of the wear edge over time as opposed to a single critical wear threshold. This may be advantageous to detect inconsistencies in the material of retainer 712, which may have undesirable process implications. The sensor path array may be used with any of the embodiments disclosed herein.

With all of the example embodiments described above, the flag triggered by the sensor when the wear edge reaches the critical wear threshold (e.g. the critical wear thickness substantially reaches zero) can be used in a variety of ways. For example, the flag may be a signal output (i.e. digital, analog or otherwise) to the CMP machine that will either activate an alarm (e.g. audible and/or visual), or it could cause the CMP machine to cease operation after the current substrate being processed is changed out.

Further, as the illustrated embodiments include the sensor being coupled to the CMP head, one of skill in the art can appreciate that the sensor may be integrated into the retainer itself. The sensor may need to be changed each time the retainer is changed. The sensor could be transferred from a used retainer to a new retainer, or the sensor could be disposable in nature. The sensor could also be part of the CMP machine control and sense-ably coupled with the sensor path from the CMP machine, but not carried by the retainer, head or carrier.

Also, though the exemplary embodiments have been discussed in regard to embodiment the manufacture of semiconductor integrated circuits, it will be recognized that the invention has a wider range of applicability; it can also be applied to flat panel displays, hard disks, raw wafers, MEMS wafers, and other objects that require a high degree of planarity.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A substrate retainer, comprising:

a body, the body having a wear edge; and a sensor path disposed in the body to sense-ably couple the wear edge to a sensor to detect at least whether a portion of the wear edge recedes to a critical wear threshold.

2. A substrate retainer as defined in claim 1, wherein the sensor path is a passage adapted to allow light to pass to the sensor when the wear edge substantially reaches the critical wear threshold.

3. A substrate retainer as defined in claim 2, wherein the sensor is a light sensitive photocell adapted to sense a change in light.

4. A substrate retainer as defined in claim 1, wherein the sensor path is a pressurized passage adapted to reach an ambient pressure when the wear edge substantially reaches the critical wear threshold.

5. A substrate retainer as defined in claim 4, wherein the sensor is a pressure sensor adapted to sense a change in pressure.

6. A substrate retainer as defined in claim 1, wherein the sensor path comprises at least two conductive traces, at least one of which having a first end positioned substantially at the critical wear threshold and a second end adapted to electrically interconnect to the sensor.

7. A substrate retainer as defined in claim 6, wherein the two conductive traces are similarly constituted, and the sensor is adapted to sense current flow and includes an open circuit when coupled to the conductive traces, such that when the wear edge reaches the critical wear threshold, the circuit is completed by a slurry that brings the first end or first ends of the conductive traces into electrical communication with each other so current is allowed to flow between the first ends.

8. A substrate retainer as defined in claim 1, wherein the sensor path comprises a conductive trace having a first end and a second end adapted for electrical communication with the sensor, the conductive trace being disposed within the sensor path such that a portion of the conductive trace is positioned substantially at the critical wear threshold.

9. A substrate retainer as defined in claim 8, wherein the sensor is adapted to sense a change in resistance and includes a closed circuit when in electrical communication with the first and second ends, the conductive trace having a known resistance, such that when the wear edge reaches the critical wear threshold, the portion of the conductive trace will be exposed to a slurry and the resistance will increase.

10. A substrate retainer as defined in claim 1, wherein a capacitor is disposed within the sensor path such that a portion of the capacitor is positioned at or near the critical wear threshold, the capacitor being adapted for electrical communication with the sensor.

11. A substrate retainer as defined in claim 10, wherein the sensor includes a capacitance-measuring device that detects a change in capacitance.

12. A substrate retainer as defined in claim 1, wherein the retainer further comprises the sensor.

13. A substrate retainer as defined in claim 1, wherein the retainer further includes one or more additional sensor paths sense-ably coupling the wear edge to the sensor, the one or more additional sensor paths having differing critical wear thresholds.

14. A CMP head, comprising:

a carrier;

a substrate backer, the backer coupled to the carrier;

a sensor adapted to generate and send a signal;

a substrate retainer coupled to the head, the substrate retainer having a body, the body having a wear edge; and a sensor path disposed in the body to sense-ably couple the wear edge to the sensor to detect at least whether a portion of the wear edge recedes to a critical wear threshold.

15. A substrate retainer as defined in claim 14, wherein the sensor path is a passage adapted to allow light to pass to the sensor when the wear edge substantially reaches the critical wear threshold.

16. A substrate retainer as defined in claim 15, wherein the sensor is a light sensitive photocell adapted to sense a change in light.

17. A substrate retainer as defined in claim 14, wherein the sensor path is a pressurized passage adapted to reach an ambient pressure when the wear edge substantially reaches the critical wear threshold.

18. A substrate retainer as defined in claim 17, wherein the sensor is a pressure sensor adapted to sense a change in pressure.

19. A substrate retainer as defined in claim 14, wherein the sensor path comprises at least two conductive traces, at least one of which having a first end positioned substantially at the critical wear threshold and a second end adapted to electrically interconnect to the sensor.

20. A substrate retainer as defined in claim 19, wherein the two conductive traces are similarly constituted, and the sensor is adapted to sense current flow and includes an open circuit when coupled to the conductive traces, such that when the wear edge reaches the critical wear threshold, the circuit is completed by a slurry that brings the first end or first ends of the conductive traces into electrical communication with each other so current is allowed to flow between the first ends.

21. A substrate retainer as defined in claim 14, wherein the sensor path comprises a conductive trace having a first end and a second end adapted for electrical communication with the sensor, the conductive trace being disposed within the sensor path such that a portion of the conductive trace is positioned substantially at the critical wear threshold.

22. A substrate retainer as defined in claim 21, wherein the sensor is adapted to sense a change in resistance and includes a closed circuit when in electrical communication with the first and second ends, the conductive trace having a known resistance, such that when the wear edge reaches the critical wear threshold, the portion of the conductive trace will be exposed to a slurry and the resistance will increase.

23. A substrate retainer as defined in claim 14, wherein a capacitor is disposed within the sensor path such that a portion of the capacitor is positioned at or near the critical wear threshold, the capacitor being adapted for electrical communication with the sensor.

24. A substrate retainer as defined in claim 23, wherein the sensor includes a capacitance-measuring device that detects a change in capacitance.

25. A substrate retainer as defined in claim 14, wherein the retainer further comprises the sensor.

26. A substrate retainer as defined in claim 14, wherein the retainer further includes one or more additional sensor paths sense-ably coupling the wear edge to the sensor, the one or more additional sensor paths having differing critical wear thresholds.

27. A method for sensing substrate retainer wear, comprising:

providing a substrate retainer coupled to a CMP head having a wear edge and a sensor path disposed in the substrate retainer;

providing a sensor;

sense-ably coupling the sensor to the wear edge via the sensor path; and monitoring the recession of the wear edge.

28. The method of claim 27, wherein the sensor is a passage adapted to allow light to pass to the sensor and the sensor is photocell adapted to detect a change in light.

29. The method of claim 27, wherein the sensor path is a pressurized passage and the sensor is a pressure sensor adapted to detect a change in pressure.

30. The method of claim 27, wherein the sensor path includes at least two conductive traces each having a first end and a second end, the first ends being positioned at a critical wear threshold and the second ends in electrical communication with the sensor, and the sensor includes an open circuit when coupled to the conductive traces.

31. The method of claim 27, wherein the sensor path includes a conductive trace having a first end and a second end adapted for electrical communication with the sensor, the conductive trace being disposed within the sensor path such that a portion of the conductive trace is positioned substantially at a critical wear threshold, the conductive trace having a known capacitance, and the sensor being a resistance detection device.

32. The method of claim 27, wherein the sensor path includes a capacitor such that a portion of the capacitor is positioned at or near a critical wear threshold, the capacitor being adapted for electrical communication with the sensor, and the sensor being a capacitance-sensing device adapted to detect a change in capacitance.

33. The method of claim 27, further comprising generating a signal when the wear edge reaches a critical wear threshold.

34. The method of claim 26, further comprising:

providing a plurality of sensor paths each having a different critical wear threshold; and generating a signal when the wear edge reaches each of the critical wear thresholds.

* * * * *

UNITED STATES PATENT AND TRADEMARK OFFICE

CERTIFICATE OF CORRECTION

PATENT NO. : 6,939,202 B2 
APPLICATION NO. : 10/640735
DATED : September 6, 2005
INVENTOR(S) : Kevin E. Heidrich and Liam S. Roberts It is certified that error appears in the above-identified patent and that said Letters Patent is hereby corrected as shown below:

Column 1
Lines 35-36, "...carrier 10..." should read --...carrier 14...--.
Line 40, "...head 14..." should read --...head 10...--.
Line 65, "...carrier 10..." should read --...carrier 14…--.

Column 2
Lines 2-3, "...ring edge 28..." should read --...wear edge 28…--.

Column 3
Line 15, "...retaining ring 212..." should read --...retainer 212…--.
Line 37, "...wear edge 22..." should read --...wear edge 222…--.

Column 4
Line 49, "...wear threshold 236..." should read --...wear threshold 436…--.

Signed and Sealed this

Tenth Day of April, 2007

JON W. DUDAS
*Director of the United States Patent and Trademark Office*